US008666277B2

(12) United States Patent
Huang et al.

(10) Patent No.: US 8,666,277 B2
(45) Date of Patent: Mar. 4, 2014

(54) DEVELOPER SUPPLY CONTAINER

(75) Inventors: Shih-Hsiung Huang, Taichung (TW); Ching-Ho Huang, Changhua County (TW)

(73) Assignee: General Plastic Industrial Co., Ltd., Taichung (TW)

( * ) Notice: Subject to any disclaimer, the term of this patent is extended or adjusted under 35 U.S.C. 154(b) by 162 days.

(21) Appl. No.: 13/462,437

(22) Filed: May 2, 2012

(65) Prior Publication Data

US 2013/0294797 A1 Nov. 7, 2013

(51) Int. Cl.
*G03G 15/08* (2006.01)

(52) U.S. Cl.
CPC ..... *G03G 15/0841* (2013.01); *G03G 15/0882* (2013.01)
USPC ..... 399/106; 399/119; 399/262

(58) Field of Classification Search
CPC ..... G03G 15/0841; G03G 15/0881; G03G 15/0882; G03G 2215/0687; G03G 2215/0692
USPC ..... 399/106, 262, 119, 120, 103
See application file for complete search history.

(56) References Cited

U.S. PATENT DOCUMENTS 6,185,401 B1 * 2/2001 Kanamori et al. ..... 399/262
7,937,018 B2 * 5/2011 Murakami et al. ..... 399/106

* cited by examiner

*Primary Examiner* — Sophia S Chen
(74) *Attorney, Agent, or Firm* — Muncy, Geissler, Olds & Lowe, PLLC

(57) ABSTRACT

A developer supply container includes a cover plate mounted on an outer surface of a container body and provided with an opening corresponding to a developer supply port of the container body, which is sealed by a seal tape. The seal tape has a folded section extending through a gap between the container body and the cover plate and a through hole of the cover plate such that an end portion of the seal tape is exposed. A seal piece is mounted on an outer surface of the cover plate. On the outer surface of the container body a door member is slidably mounted. The developer supply container can prevent developer from leak out and has a good manufacturing yield rate.

8 Claims, 4 Drawing Sheets

DEVELOPER SUPPLY CONTAINER

BACKGROUND OF THE INVENTION

1. Field of the Invention

The present invention relates generally to developer supply containers for supplying developer to electronic image forming apparatuses, and more particularly to a developer supply container that can effectively prevent developer from leak out and has a good manufacturing yield rate.

2. Description of the Related Art

It is known that a conventional developer supply container has a developer supply port around which a seal piece of foam material is provided. After the developer supply container is installed in an electronic image forming apparatus, such as a copying machine, a printer, etc., the seal piece will seal the surrounding of the developer supply port and the surrounding of a developer receiving port of the electronic image forming apparatus so as to prevent developer from leak out. In the process of transportation or storage, the developer supply port of the developer supply container needs to be sealed in order to prevent developer from leak out. To achieve this purpose, it is commonly seen that a seal tape having a width wider than that of the seal piece is used and adhered by heat pressing on a portion of a container body, which surrounds the seal piece, to sealedly cover both of the seal piece and the developer supply port, and a door member is additionally used and mounted to the container body for covering the seal tape.

The manufacturing yield rate of the above-mentioned conventional developer supply container tends to drop down due to an improper operation during the assembling process. For example, if the seal tape is accidently pressed on the seal piece in the process of applying the seal tape to the container body, the seal tape and the seal piece will be adhesively bonded together, resulting in that the seal piece will be damaged to cause deterioration on sealing effect when the seal tape is torn off after the developer supply container is installed in the electronic image forming apparatus. In addition, since the seal tape is arranged on a place outside the seal piece, the seal tape may damage or escape due to pull when the door member is assembled to the container body. Further, the outer surface of the container body can provide with a limited width for mounting of the seal tape and the seal tape has to be wider than the seal piece, so that the anti-leak effect of the conventional developer supply container may be unsatisfied due to the insufficient width of the seal piece.

SUMMARY OF THE INVENTION

It is one objective of the present invention to provide a developer supply container, which can prevent the seal piece from damage as the seal tape is removed so as to prevent developer from leak out.

Another objective of the invention is to provide a developer supply container, which can prevent the seal tape from damage or escape as the developer supply container is assembled so as to enhance the manufacturing yield rate thereof.

To achieve the above-mentioned objectives, the developer supply container provided by the present invention comprises a container body, a cover plate, a seal tape, a seal piece and a door member. The container body has a developer supply port. The cover plate is mounted on an outer surface of the container body in such a way that a gap is formed between the cover plate and the container body. The cover plate has an opening corresponding to the developer supply port, and a through hole adjacent to an end of the opening. The seal tape has a main section mounted on the container body to seal the developer supply port, and a folded section extending from the main section and passing through the gap and the through hole such that an end portion of the seal tape is exposed outside the cover plate. The seal piece is mounted on an outer surface of the cover plate and provided with an opening corresponding to the opening of the cover plate. The door member is slidably mounted on the outer surface of the container body and moveable relative to the container body between a first position where the opening of the seal piece is closed by the door member, and a second position where the opening of the seal piece is opened.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
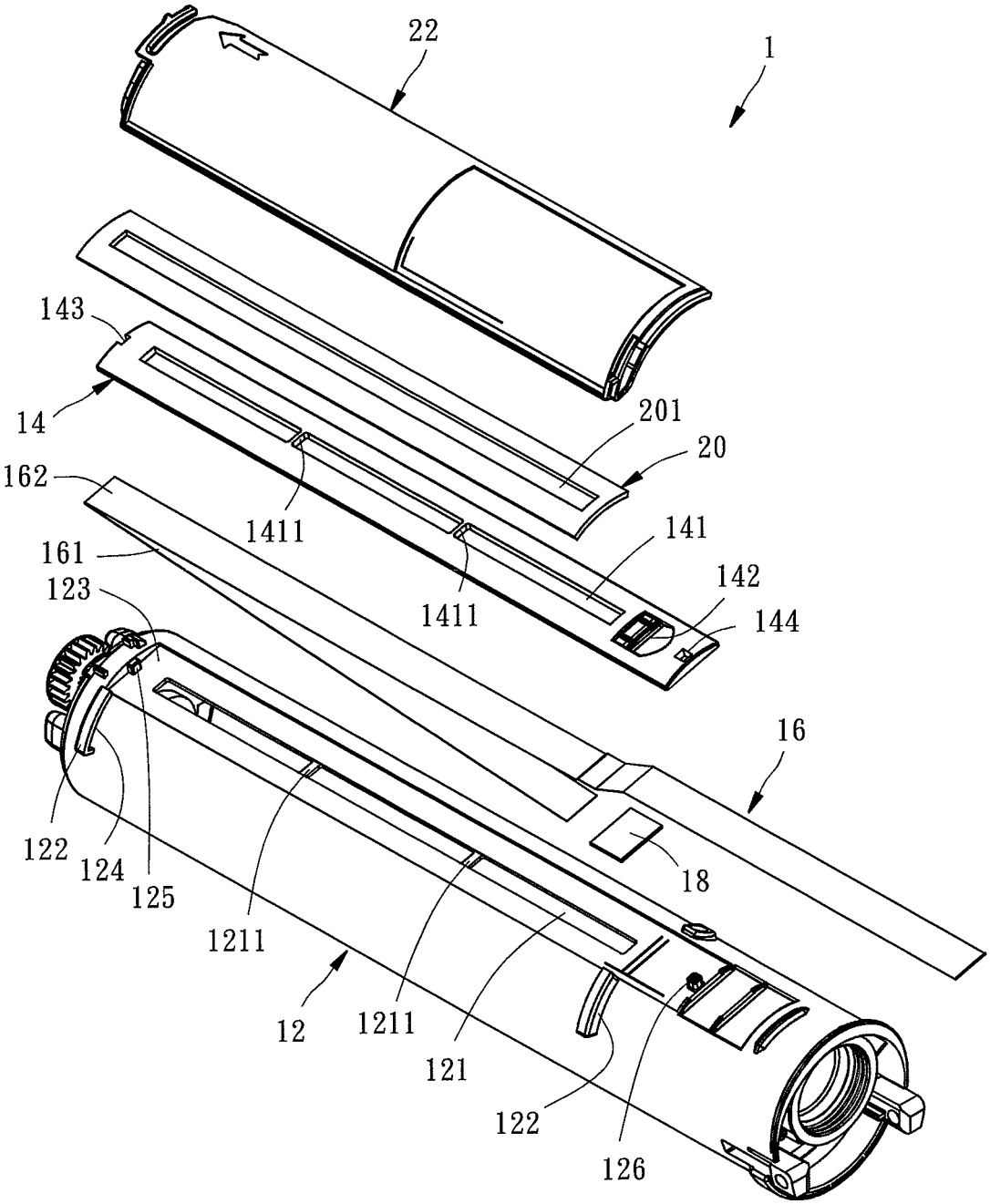
FIG. 1 is an exploded view of a developer supply container according to a preferred embodiment of the present invention.
Figure 2:
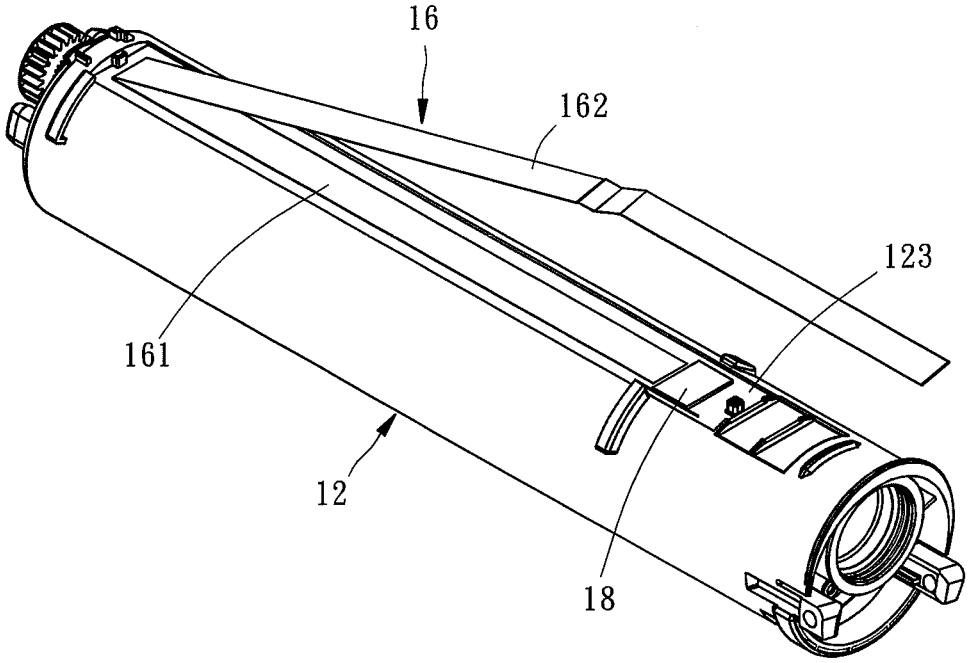
FIG. 2 is a perspective view showing that a seal tape and a pad are mounted on the container body of the developer supply container according to the preferred embodiment of the present invention.
Figure 3:
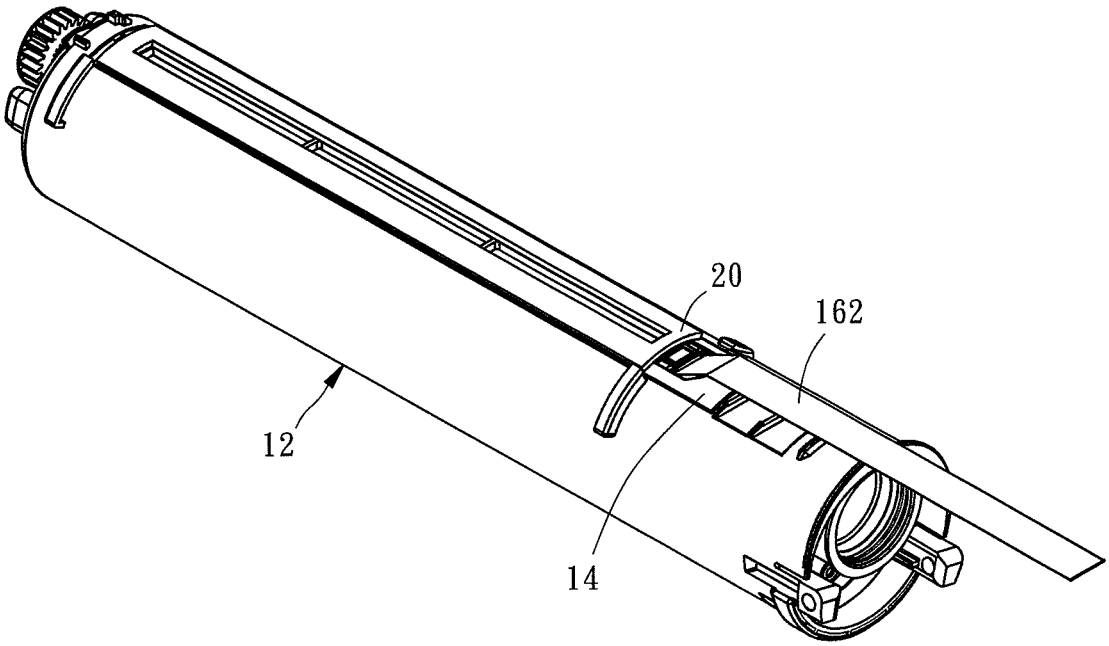
FIG. 3 is a perspective view showing that the container body, the seal tape, the pad, the cover plate and the seal piece are assembled.
Figure 4:
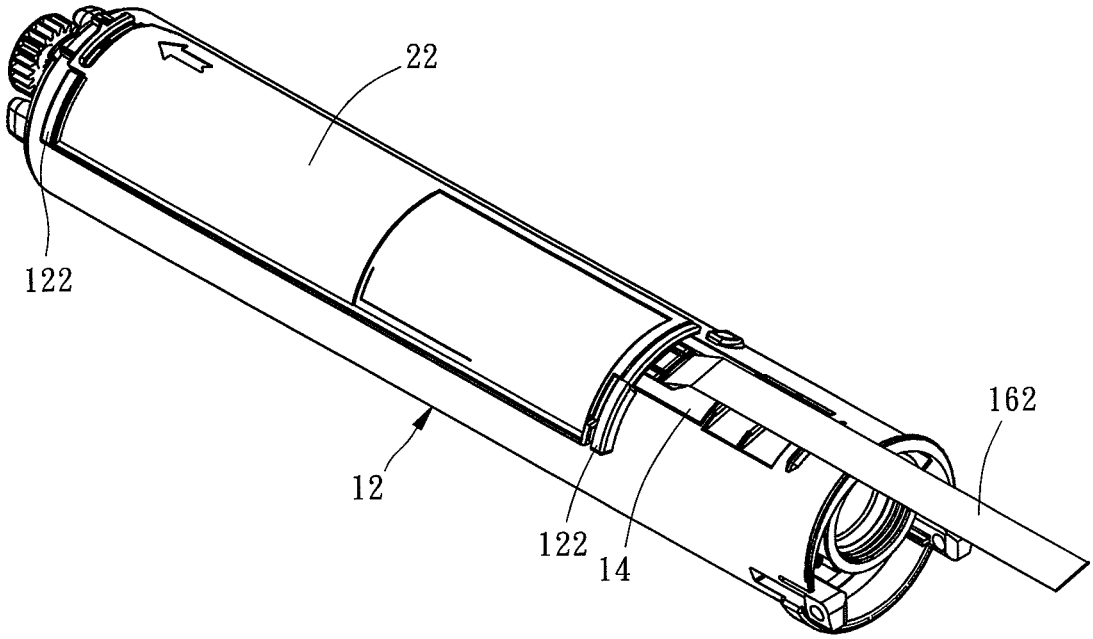
FIG. 4 a perspective view of the developer supply container according to the preferred embodiment of the present invention.

As shown in FIGS. 1-6, a developer supply container 1 provided by a preferred embodiment of the present invention comprises a container body 12, a cover plate 14, a seal tape 16, a pad 18, a seal piece 20 and a door member 22.

The container body 12 is provided with a developer supply port 121, two guide rails 122 extending circumferentially. On the outer surface of the container body 12 a recessed portion 123 is provided for mounting of the cover plate 14. The developer supply port 121 is located at the recessed portion 123. In order to enhance the structural strength, two bridges 1211 are provided across the developer supply port 121. The guide rails 122 are spaced from each other at a predetermined distance and each have a guide slot 124. Two first connecting portions 125 and 126 are provided on the recessed portion 123. In this embodiment, the first connecting portions 125 and 126 are protrusions that are located at places spacedly and respectively corresponding to two ends of the developer supply port 121.

The cover plate 14 is mounted in the recessed portion 123 of the outer surface of the container body 12 in such a way that a gap 24 is formed between the container body 12 and the cover plate 14. The cover plate 14 has an opening 141 corresponding in location and configuration to the developer supply port 121, a through hole 142 adjacent to an end of the opening 141, and two second connecting portions 143 and 144 having configurations respectively complementary to those of the first connecting portions 125 and 126. In this embodiment, the second connecting portion 143 is a notch provided at the left end of the cover plate 14 and coupled with the first connecting portion 125, and the second connecting portion 144 is a through hole located adjacent to the right end of the cover plate 14 and coupled with the first connecting portion 126. It'll be appreciated that the second connecting portion 144 may be realized as a recess, not limited to a through hole as shown in the drawing. Similarly, two bridges 1411 are provided across the opening 141 to enhance the structural strength of the cover plate 14.

The seal tape 16 includes a main section 161, which is mounted on the container body 12 by back adhesive to seal the developer supply port 121, and a folded section 162 integrally extending from the main section 161. The folded section 162 further extends through the gap 24 and then passes through the through hole 142 of the cover plate 14, such that an end portion of the seal tape 16 is exposed outside the cover plate 14. The seal tape 16 can be made of, but not limited to a polyethylene terephthalate (PET) material. The width of the main section 161 of the seal tape 16 is not limited; however, it shall be greater than that of the developer supply port 121 for enabling the main section 161 to seal the developer supply port 121.

The pad 18 is mounted on the container body 12 and located beneath the through hole 142 of the cover plate 14. The pad 18 is preferably made of a resilient material, such as but not limited to a foam material. A part of the seal tape 16, which is located beneath the through hole 142 of the cover plate 14, is sandwiched between the pad 18 and the cover plate 14.

The seal piece 20 is mounted on an outer surface of the cover plate 14 and provided with an opening 201 corresponding in location and configuration to the opening 141 of the cover plate 14. The seal piece 20 is preferably made of a resilient material, such as but not limited to a foam material. As shown in the drawings, the seal tape 16 and the seal piece 20 are separated by the cover plate 14. When the developer supply container 1 is assembled, this design can prevent the seal tape from accidently heat pressing on the seal piece, which is a problem that the conventional developer supply container may have, so as to enhance the manufacturing yield rate of the developer supply container 1 and lower the manufacturing cost. In addition, since the seal piece 20 and the seal tape 16 are separately arranged in the developer supply container 1, the seal piece 20 can be provided with a wider width, which can solve the problem of the unsatisfied anti-leak effect that the conventional structure may have.

Figure 5:
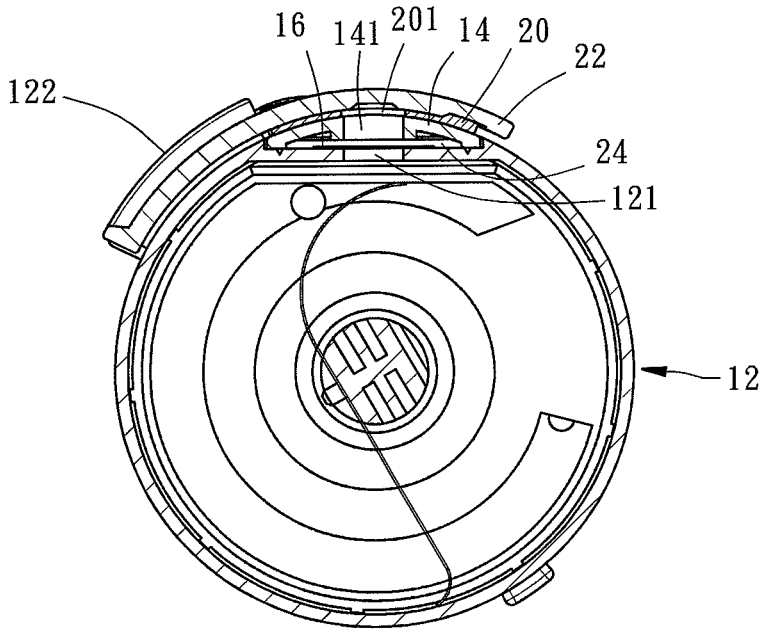
FIGS. 5 and 6 are sectional views of the developer supply container according to the preferred embodiment of the present invention.
Figure 6:
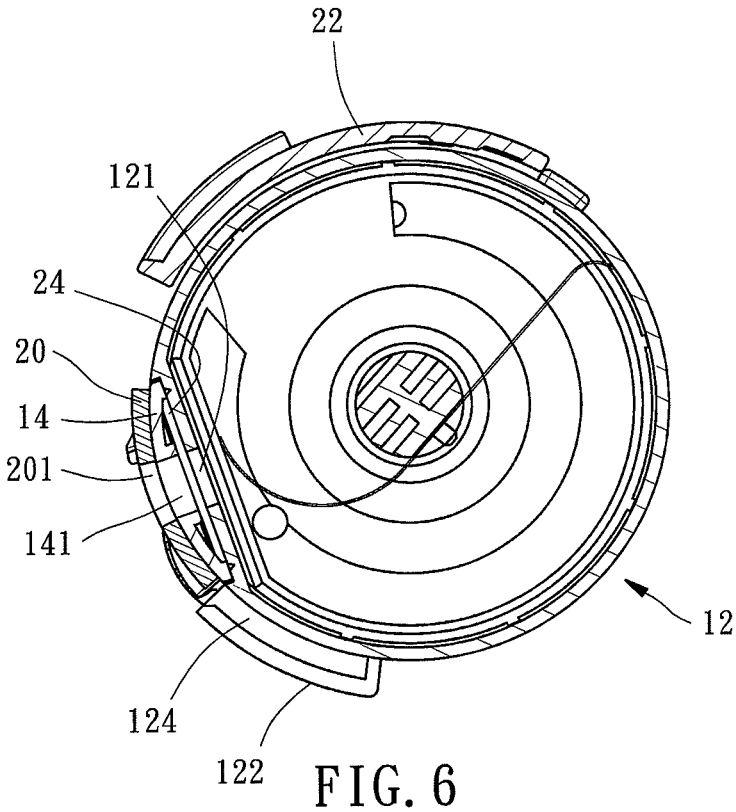

The door member 22 is coupled with the guide rails 122 in such a way that the door member 22 is circumferentially slidably mounted on the outer surface of the container body 12. As a result, the door member 22 is moveable relative to the container body 12 between a first position where the opening 201 of the seal piece 20 and the developer supply port 121 are sealedly closed by the door member 22 as shown in FIG. 5, and a second position where the opening 201 of the seal piece 20 and the developer supply port 121 are not closed by the door member 22, i.e. the opening 201 and the developer supply port 121 are opened as shown in FIG. 6.

Before the developer supply container 1 is installed in an electronic image forming apparatus (not shown in the drawings), the door member 22 coupled with the guide rails 124 is located at the first position. When the developer supply container 1 is inserted into a receptacle of the electronic image forming apparatus, which is not shown in the drawings, the door member 22 is coupled with and held stationarily by the receptacle of the electronic image forming apparatus. Thereafter, the user can pull the folded section 162 of the seal tape 16 to remove the seal tape 16 from the developer supply container 1, and then the user can turn the container body 12 counterclockwise such that the container body 12 moves relative to the door member 22 to enable the door member 22 to be stayed at the so-called second position as shown in FIG. 6, resulting in that the developer can be filled into the electronic image forming apparatus through the developer supply port 121, the opening 141 and the opening 201. During the process of removing the seal tape 16, because the part of the seal tape 16 located beneath the through hole 142 of the cover plate 14 will be pressed on the bottom surface of the cover plate 14 by the pad 18, the developer remained on the surface of the main section 161 of the seal tape 16 will be scraped by the cover plate 14 so as to prevent the developer from leak out and waste.

When the container body 12 runs out of the developer, the container body 12 can be turned back to make the door member 22 move relative to the container body 12 to the first position, such that the door member 22 is again engaged with the guide slots 124 of the guide rails 122 to seal the opening 201 of the seal piece 20 and the developer supply port 121. Thereafter, the empty developer supply container 1 can be removed out of the electronic image forming apparatus. The developer supply container 1 provided by the present invention can prevent the remained developer from leak out so as to avoid the developer contamination during removal of developer supply container 1.

According to the design of the developer supply container 1 of the present invention, because the seal tape 16 is directly mounted on the container body 12 and the seal piece 20 is mounted on the outer surface of the cover plate 14, the seal tape 16 doesn't need to have a width greater than that of the seal piece 20 as the conventional developer supply container does, and the problem that the seal tape accidently presses on and adheres with the seal member, which may usually occurs in the assembly process of the conventional developer supply container, no longer exists. In addition, the seal piece 20 will not damage upon removal of the seal tape 16 and the seal piece 20 can be provided with a great width to enhance the anti-leak effect.

Further, according to the design of the present invention, the seal tape 16 is arranged between the container body 12 and the cover plate 14. This can prevent the seal tape 16 from damage or escape due to pull or stretch at the time when the door member 22 is engaged with the guide slots 124 of the guide rails 122 in assembly process, thereby enhancing the manufacturing yield rate.

It'll be appreciated that the seal member 20 may be made of any suitable material, including but not limited to foam material including polyurethane foam, or knitting material or non-woven material containing wool fiber, silk fiber, cotton fiber, flax fiber, nylon fiber, polyester fiber or acrylic fiber.

The developer supply container 1 can be made with various modifications based on the spirit of the present invention. For example, the container body 12 can be designed without such recessed portion 123, the pad 18 can be eliminated, one or more first connecting portions can be provided on the recessed portion 123 and one or more second connecting portions corresponding in amount, location and configuration to the first connecting portions can also be provided at the cover plate 14, or the first and second connecting portions can be eliminated. Such variations are not to be regarded as a departure from the spirit and scope of the invention, and all such modifications as would be obvious to one skilled in the art are intended to be included within the scope of the following claims.

What is claimed is:

1. A developer supply container comprising:

a container body provided with a developer supply port;

a cover plate mounted on an outer surface of the container body such that a gap is formed between the cover plate and the container body, the cover plate being provided an opening corresponding to the developer supply port, and a through hole adjacent to an end of the opening;

a seal tape having a main section mounted on the container body to seal the developer supply port, and a folded section extending from the main section and through the gap and the through hole of the cover plate such that an end portion of the seal tape is exposed outside the cover plate;

a seal piece mounted on an outer surface of the cover plate and provided with an opening corresponding to the opening of the cover plate; and a door member slidably mounted on the outer surface of the container body and moveable relative to the container body between a first position where the opening of the seal piece is closed by the door member, and a second position where the opening of the seal piece is opened.

2. The developer supply container as claimed in claim 1, wherein the seal tape is made of a polyethylene terephthalate material.

3. The developer supply container as claimed in claim 1, wherein the seal piece is made of a foam material.

4. The developer supply container as claimed in claim 1, wherein the outer surface of the container body is provided with a recessed portion on which the cover plate in mounted.

5. The developer supply container as claimed in claim 4, wherein the recessed portion of the container body is provided with a first connecting portion and the cover plate is provided with a second connecting portion, which has a configuration complementary to that of the first connecting portion and is coupled with the first connecting portion.

6. The developer supply container as claimed in claim 5, wherein the first connecting portion of the container body is a protrusion and the second connecting portion is a recess, a notch or a through hole.

7. The developer supply container as claimed in claim 1, further comprising a pad mounted to the container body and located beneath the through hole of the cover plate.

8. The developer supply container as claimed in claim 7, wherein the pad is made of a foam material.

* * * * *